US010669836B2

(12) United States Patent
Wu et al.

(10) Patent No.: US 10,669,836 B2
(45) Date of Patent: Jun. 2, 2020

(54) SURFACE EXCITATION RANGING METHODS AND SYSTEMS EMPLOYING A GROUND WELL AND A SUPPLEMENTAL GROUNDING ARRANGEMENT

(71) Applicant: Halliburton Energy Services, Inc., Houston, TX (US)

(72) Inventors: Hsu-Hsiang Wu, Sugar Land, TX (US); Akram Ahmadi Kalateh Ahmad, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 268 days.

(21) Appl. No.: 15/555,931

(22) PCT Filed: Mar. 25, 2015

(86) PCT No.: PCT/US2015/022518

§ 371 (c)(1),
(2) Date: Sep. 5, 2017

(87) PCT Pub. No.: WO2016/153504

PCT Pub. Date: Sep. 29, 2016

(65) Prior Publication Data

US 2018/0045034 A1 Feb. 15, 2018

(51) Int. Cl.
*E21B 47/022* (2012.01)
*E21B 7/04* (2006.01)

(52) U.S. Cl.
CPC ..... *E21B 47/02216* (2013.01); *E21B 7/04* (2013.01)

(58) Field of Classification Search
CPC ..... E21B 47/02216; E21B 7/04
(Continued)

(56) References Cited

U.S. PATENT DOCUMENTS 4,791,373 A 12/1988 Kuckes
5,218,301 A 6/1993 Kuckes
(Continued)

FOREIGN PATENT DOCUMENTS

AU 2015387496 9/2016
RU 2515930 5/2014
(Continued)

OTHER PUBLICATIONS

European Search Report for Application No. EP15886659 dated Oct. 11, 2018.
(Continued)

*Primary Examiner* — Yaritza Guadalupe-McCall
(74) *Attorney, Agent, or Firm* — Jason Sedano; C. Tumey Law Group PLLC

(57) ABSTRACT

A surface excitation ranging method includes selecting a first well with a metal casing as a target well and selecting a second well with a metal casing as a ground well. The method also includes installing a supplemental grounding arrangement for a power supply located at earth's surface, wherein the ground well and the supplemental grounding arrangement fulfill an impedance criteria or ranging performance criteria. The method also includes conveying an electrical current output from the power supply along the target well. The method also includes sensing electromagnetic (EM) fields emitted from the target well due to the electrical current. The method also includes using distance or direction information obtained from the sensed EM fields to guide drilling of a new well relative to the target well.

20 Claims, 6 Drawing Sheets

(58) Field of Classification Search
USPC ..... 33/304
See application file for complete search history.

(56) References Cited

U.S. PATENT DOCUMENTS

| | | | | |
|---|---|---|---|---|
| 5,343,152 | A | 8/1994 | Kuckes | |
| 5,676,212 | A | 10/1997 | Kuckes | |
| 7,812,610 | B2 * | 10/2010 | Clark | G01V 3/26 324/338 |
| 10,001,006 | B2 * | 6/2018 | Donderici | E21B 47/02216 |
| 2007/0278008 | A1 | 12/2007 | Kuckes et al. | |
| 2012/0061143 | A1 | 3/2012 | Hay | |
| 2012/0326723 | A1 * | 12/2012 | Bloemenkamp | G01V 3/24 324/356 |
| 2015/0369036 | A1 * | 12/2015 | Hay | E21B 10/00 175/45 |
| 2018/0038219 | A1 * | 2/2018 | Ahmadi Kalateh Ahmad | E21B 47/024 |
| 2018/0045034 | A1 * | 2/2018 | Wu | E21B 7/04 |
| 2018/0258755 | A1 * | 9/2018 | Donderici | G01V 3/26 |
| 2019/0162064 | A1 * | 5/2019 | Donderici | E21B 47/122 |

FOREIGN PATENT DOCUMENTS

| | | |
|---|---|---|
| WO | 2014089402 | 6/2014 |
| WO | 2016153507 | 9/2016 |

OTHER PUBLICATIONS

International Search Report and Written Opinion for PCT/US2015/022518 dated Dec. 18, 2015.
Russian Search Report for Application No. 2017129887 dated Jun. 29, 2018.
Argentina OA for Application No. AR 103841 A1 dated Sep. 26, 2019.

* cited by examiner

SURFACE EXCITATION RANGING METHODS AND SYSTEMS EMPLOYING A GROUND WELL AND A SUPPLEMENTAL GROUNDING ARRANGEMENT

BACKGROUND

The world depends on hydrocarbons to solve many of its energy needs. Consequently, oilfield operators strive to produce and sell hydrocarbons as efficiently as possible. Much of the easily obtainable oil has already been produced, so new techniques are being developed to extract less accessible hydrocarbons. One such technique is steam-assisted gravity drainage ("SAGD") as described in U.S. Pat. No. 6,257,334, "Steam-Assisted Gravity Drainage Heavy Oil Recovery Process". SAGD uses a pair of vertically-spaced, horizontal wells less than about 10 meters apart.

In operation, the upper well is used to inject steam into the formation. The steam heats the heavy oil, thereby increasing its mobility. The warm oil (and condensed steam) drains into the lower well and flows to the surface. A throttling technique is used to keep the lower well fully immersed in liquid, thereby "trapping" the steam in the formation. If the liquid level falls too low, the steam flows directly from the upper well to the lower well, reducing the heating efficiency and inhibiting production of the heavy oil. Such a direct flow (termed a "short circuit") greatly reduces the pressure gradient that drives fluid into the lower well.

Short circuit vulnerability can be reduced by carefully maintaining the inter-well spacing, i.e., by making the wells as parallel as possible. (Points where the inter-well spacing is smaller than average provide lower resistance to short circuit flows.) In the absence of precision drilling techniques, drillers are forced to employ larger inter-well spacings than would otherwise be desirable, so as to reduce the effects of inter-well spacing variations. Precision placement of neighboring wells is also important in other applications, such as collision avoidance, infill drilling, observation well placement, coal bed methane degasification, and wellbore intersections for well control.

Electromagnetic (EM) ranging solutions have been developed to directly sense and measure the distance between pipes is nearby wells as the drilling commences in the latter well. Some multi-well EM ranging techniques are not cost effective as they involve multiple teams to deploy one or more wireline tools in an existing well, while a logging-while-drilling (LWD) is deployed in the new well being drilled. Meanwhile, some single-well EM ranging techniques rely on absolute magnetic field measurements for distance calculation, which does not produce reliable results due to variations of the current on the target pipe.

Another EM ranging technique, referred to herein as surface excitation ranging, utilizes a current source located at earth's surface and a target well. Specifically, current from the current source is provided to a metal casing of the target well, which causes the target well to emit EM fields along its length. The EM fields emitted from the target well can be used to guide drilling of a new well near the target well. Due to current leakage from the target well into the surrounding formation, surface excitation ranging can produce weak EM fields and poor signal-to-noise ratio (SNR) for sensors in deep wells. Increasing the amount of current injected into the target well would improve the EM field strength and SNR available for ranging, but such increases in current are not always possible for a given power supply and can be a safety hazard to workers at earth's surface. In surface excitation ranging scenarios involving a ground well, increases in current also increase the likelihood of interference between EM fields emitted from the ground well and EM fields emitted from the target well.

BRIEF DESCRIPTION OF THE DRAWINGS

Accordingly, there are disclosed herein surface excitation ranging methods and systems employing a ground well and a supplemental grounding arrangement. In the drawings.

Figure 1:
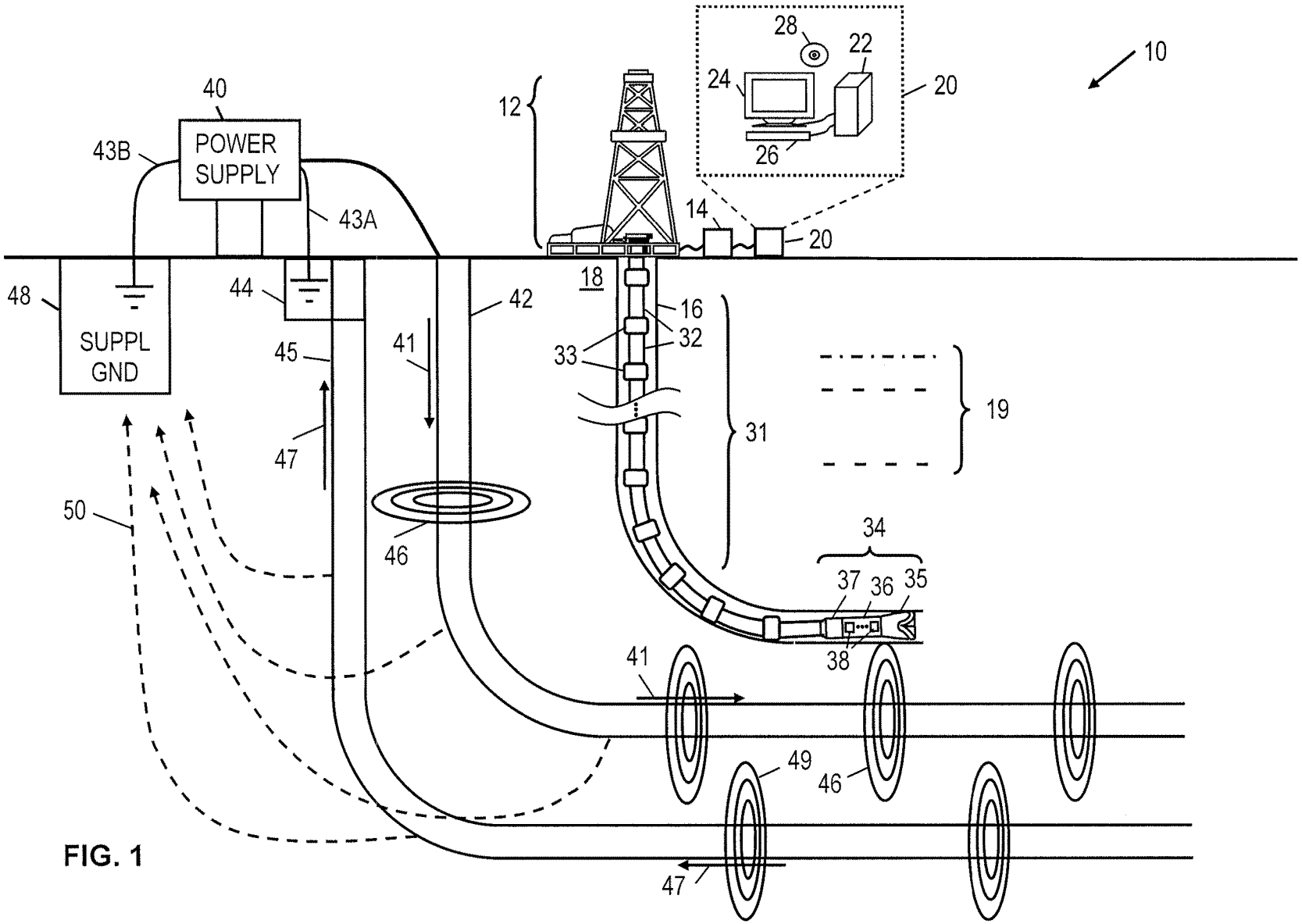
FIG. 1 is a schematic diagram of an illustrative surface excitation ranging scenario involving a ground well and a supplemental grounding arrangement.

It should be understood, however, that the specific embodiments given in the drawings and detailed description below do not limit the disclosure. On the contrary, they provide the foundation for one of ordinary skill to discern the alternative forms, equivalents, and other modifications that are encompassed in the scope of the appended claims.

DETAILED DESCRIPTION

Disclosed embodiments are directed to surface excitation ranging methods and systems employing a ground well and a supplemental grounding arrangement. Use of a ground well and a supplemental grounding arrangement as described herein enables customization of the balance between different surface excitation ranging issues including: 1) safety; 2) ranging performance; and 3) availability of supplemental grounding options. For comparison, a base grounding arrangement that involves staking one or more traditional ground stakes at earth's surface (each traditional ground stake having a radius of about 1 centimeter, a length of about 1 meter, and a conductivity of about $10^6$ S/m) may be unsafe in some surface excitation ranging scenarios, especially where high current levels are needed. Further, ranging performance when using a ground well alone may be inadequate in some surface excitation ranging scenarios due is to interference caused by electromagnetic (EM) fields emitted from the ground well. At least for some surface excitation ranging scenarios, the combination of a ground well and a supplemental grounding arrangement provides improved safety and ranging performance compared to a base grounding arrangement alone or a ground well alone.

In some embodiments, a supplemental grounding arrangement involves one or more traditional ground stakes. Additionally or alternatively, a supplemental grounding arrangement involves customized ground stakes having an increased length and/or an increased radius relative to a traditional ground stake. Further, a supplemental grounding arrangement may involve a customized ground stake having deeper deployment and/or increased contact with the earth relative to a traditional ground stake. In different embodiments, an open borehole and/or a pilot hole can be used to control deployment depth of a customized ground stake and/or the amount of contact between a customized ground stake and the earth. Other supplemental grounding arrangement options involve using a downhole casing (e.g., another ground well) or rig anchor as a type of customized ground stake. In some embodiments, different supplemental grounding arrangement options are selected or combined until an impedance criteria and/or ranging performance criteria of a ground well and the supplemental grounding arrangement is met. Such criteria may vary, for example, depending on the length of a particular target well and/or the electrical properties (e.g., resistivity, conductivity, permeability) of the formation surrounding the target well. Previous test results, ongoing test results, or circumstances (e.g., availability of components, equipment, nearby open boreholes or downhole casings) may be used to select a particular supplemental grounding arrangement.

In at least some embodiments, an example surface excitation ranging method includes selecting a first well with a metal casing as a target well. The method also includes selecting a second well with a metal casing as a ground well. The method also includes installing a supplemental grounding arrangement for a power supply located at earth's surface, wherein the ground well and the supplemental grounding arrangement fulfill an impedance criteria or ranging performance criteria. The method also includes conveying an electrical current output from the power supply along the target well. The method also includes sensing EM fields emitted from the target well due to the electrical current. The method also includes using distance or direction information obtained from the sensed EM fields to guide drilling of a new well relative to the target well.

Meanwhile, an example surface excitation system includes a power supply located at earth's surface. The system also includes a ground well and a supplemental grounding arrangement for the power supply, wherein the ground well and the supplemental grounding arrangement fulfill an impedance criteria or a ranging performance criteria. The system also includes a target well with a metal casing to convey an electrical current output from the power supply along its length. The system also includes at least one sensor to detect EM fields emitted from the target well due to the electrical current. The system also includes a directional drilling tool to drill a new well relative to the target well based on distance or direction information obtained from the detected EM fields. Various ground well and supplemental grounding arrangement options are disclosed herein.

The disclosed surface excitation ranging methods and systems employing a ground well and a supplemental grounding arrangement are best understood when described in an illustrative usage context. FIG. 1 shows an illustrative surface excitation ranging scenario 10 involving a ground well 45 and a supplemental grounding arrangement 48. In scenario 10, a new well 16 is being drilled relative to a target well 42 that has already been drilled and cased. The target well 42 can be drilled using known drilling equipment. The new well 16 is drilled in the same manner, but with surface excitation ranging operations to guide drilling of the new well 16 relative to the target well 42. More specifically, the new well 16 is drilled using a drilling assembly 12 that enables a drill string 31 to be lowered to create new well 16 that penetrates formations 19 of the earth 18. The drill string 31 is formed, for example, from a modular set of drill string segments 32 and possibly adaptors 33. At the lower end of the drill string 31, a bottomhole assembly (BHA) 34 with a drill bit 35 removes material from the earth 18. To facilitate removal of material, the drill bit 35 can rotate by turning the drill string 31 with the drilling assembly 12 and/or by use of a motor (e.g., a mud motor) included with the BHA 34. Further, drilling fluid can be circulated to remove cuttings from the new well 16. For example, such drilling fluid can be pumped down the drill string 31, out orifices in the drill bit 35, and back to earth's surface along the annular space in the new well 16.

The bottomhole assembly 34 also includes one or more drill collars 37 and a logging tool 36 with one or more EM field sensor units 38 and/or other sensors. In some embodiments, the EM field sensor units 38 correspond to a plurality of inductive loops oriented in different directions. In the surface excitation ranging scenario 10, the EM field sensor units 38 measure EM fields 46 generated by an electrical current conveyed by a metal casing in the target well 42, where the electrical current is provided to the target well 42 by a power supply 40 at earth's surface. The logging tool 36 may also include electronics for data storage, communications, etc. The EM field measurements and/or other measurements collected by the logging tool 36 are conveyed to earth's surface and/or are stored by the logging tool 36. In either case, the EM field measurements can be processed (downhole or at earth's surface) to determine distance or direction information that can be used to guide directional drilling operations that determine the trajectory of the new well 16. In at least some embodiments, the determined distance or direction information corresponds to the distance and direction of the BHA 34 (or a point along the BHA 34) relative to the target well 42.

To convey EM field measurements or other types of measurements to earth's surface, the logging tool 36 may employ one or more telemetry options such as mud pulse telemetry, acoustic telemetry, EM telemetry, and/or wired telemetry. At earth's surface, an interface 14 receives measurements from the logging tool 36 and conveys the measurements to a computer system 20. In some embodiments, the surface interface 14 and/or the computer system 20 may perform various operations such as converting signals from one format to another, storing measurements and/or processing measurements. As an example, in at least some embodiments, the computer system 20 includes a processing unit 22 that determines distance and/or direction information from EM field measurements as described herein by executing software or instructions obtained from a local or remote non-transitory computer-readable medium 28. The computer system 20 also may include input device(s) 26 (e.g., a keyboard, mouse, touchpad, etc.) and output device(s) 24 (e.g., a monitor, printer, etc.). Such input device(s) 26 and/or output device(s) 24 provide a user interface that enables an operator to interact with the logging tool 36 and/or software executed by the processing unit 22. For example, the computer system 20 may enable an operator to view collected measurements, to view processing results, to select power supply options, to select directional drilling options, and/or to perform other tasks related to scenario 10.

In scenario 10, a supplemental grounding arrangement 48 for the power supply 40 is represented, where the ground well 45 and the supplemental grounding arrangement 48 fulfill an impedance criteria or ranging performance criteria. In at least some embodiments, the power supply 40 is connected to the ground well 45 via an insulated cable 43A and coupler 44. Meanwhile, the power supply 40 may connect to the supplemental grounding arrangement 48 via insulated cable 43B. In some embodiments, the insulated cables 43A and 43B may extend from the power supply 40 to locations below earth's surface to connect to the ground well 45 and the supplemental grounding arrangement 48. The current 41 output from the power supply 40 is conveyed along the target well 42, resulting in EM fields 46 that can be used for ranging. To the extent leakage currents 50 from the target well 42 reach the ground well 45, a return current 46 is conveyed along the ground well 45 in a direction opposite the current 41 conveyed along the target well, resulting in EM fields 49 that potentially interfere with ranging operations. For example, the EM field sensor units 38 may detect EM fields 49 instead of or in addition to EM fields 46, resulting in incorrect ranging information. Further, at least some of the leakage currents 50 from the target well 42 and/or the ground well 45 return to the supplemental grounding arrangement 48. Due to the leakage currents 50, the amount of electrical current conveyed along the target well 42 attenuates over the length of the target well 42. To improve the strength of the EM fields 46 emitted by the target well 42, the voltage and/or current levels output from the power supply 40 can be increased (or perhaps a larger capacity power supply can be used). However, such increases in the voltage and/or current levels output from the power supply 40 may raise the risk of injury to workers at earth's surface, especially if components of the power supply 40 or the supplemental grounding arrangement 48 are exposed to earth's surface. Further, such increases in the voltage and/or current levels output from the power supply 40 increase the likelihood that the EM fields 49 will reach the EM field sensor units 38 and interfere with the intended ranging operations. In an example surface excitation ranging scenario, the current level is 100 A and the voltage level is between 40-50V, resulting in a power level of 4-5 kW.

Accordingly, the ground well 45 and the supplemental grounding arrangement 48 fulfill an impedance criteria and/or ranging performance criteria that reduces the level of risk involved while enabling ranging operations as the new well 16 extends further along relative to the target well 42. As needed, adjustments can be made to the supplemental grounding arrangement 48 to reduce the impedance in response to one or more tests. For example, the test may measure an impedance associated with the ground well 45 and/or the supplemental grounding arrangement 48. Another example test may measure signal-to-noise-ratio (SNR) of the EM fields 46 at some point along the target well 42.

Figure 2A:
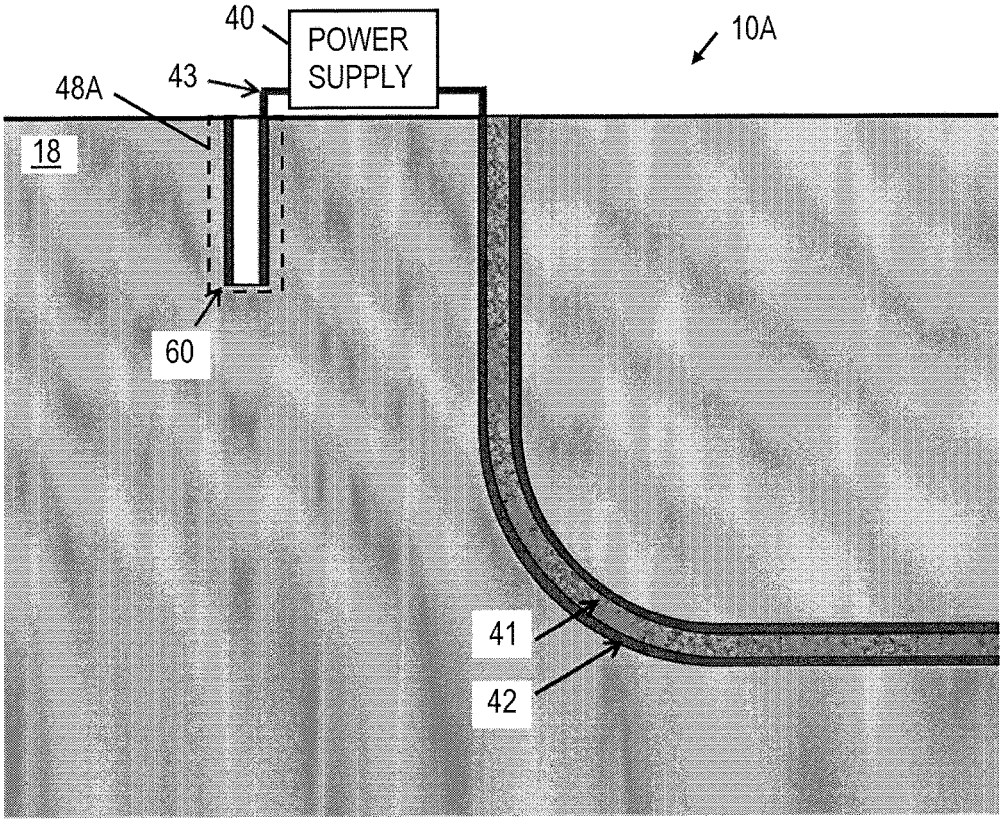
FIG. 2A is a schematic diagram showing part of surface excitation ranging scenario including a first supplemental grounding arrangement.

There are various options available for the supplemental grounding arrangement 48. FIG. 2A shows part of a surface excitation ranging scenario 10A that includes a first supplemental grounding arrangement 48A. In scenario 10A, the target well 42 is represented as being filled with low-resistivity drilling mud 41, and the first customized grounding arrangement 48A is shown to include a downhole casing 60 connected to the power supply 40 via an insulated cable 43. The downhole casing 60 may be correspond to one or more one casing segments (each segment typically has a length of about 30 feet) in contact with the earth 18. In some embodiments, the downhole casing 60 is installed in response to a test (e.g., an impedance test or ranging SNR test). Alternatively, the downhole casing 60 may be available due to other wells having been previously drilled and cased. When available, a downhole casing 60 that is spaced from and within a predetermined range of the target well 42 can be used to supplement a ground well (not shown). While the downhole casing 60 is shown to extend vertically, it should be appreciated that other downhole casing variations may extend hortizontally as well. When available, downhole casing 60 could corresponding to a supplemental ground well. A downhole casing 60 as in the surface excitation ranging scenario 10A may also be combined with other supplemental grounding arrangement options described herein. The impedance for a customized grounding arrangement involving a downhole casing 60 with $\sigma=10^6$S/m, $\mu_r=100$, outer radius=0.1 meters, inner radius=0.09 meters, and length=30 meters, has been estimated to be about 0.46 ohms.

Figure 2B:
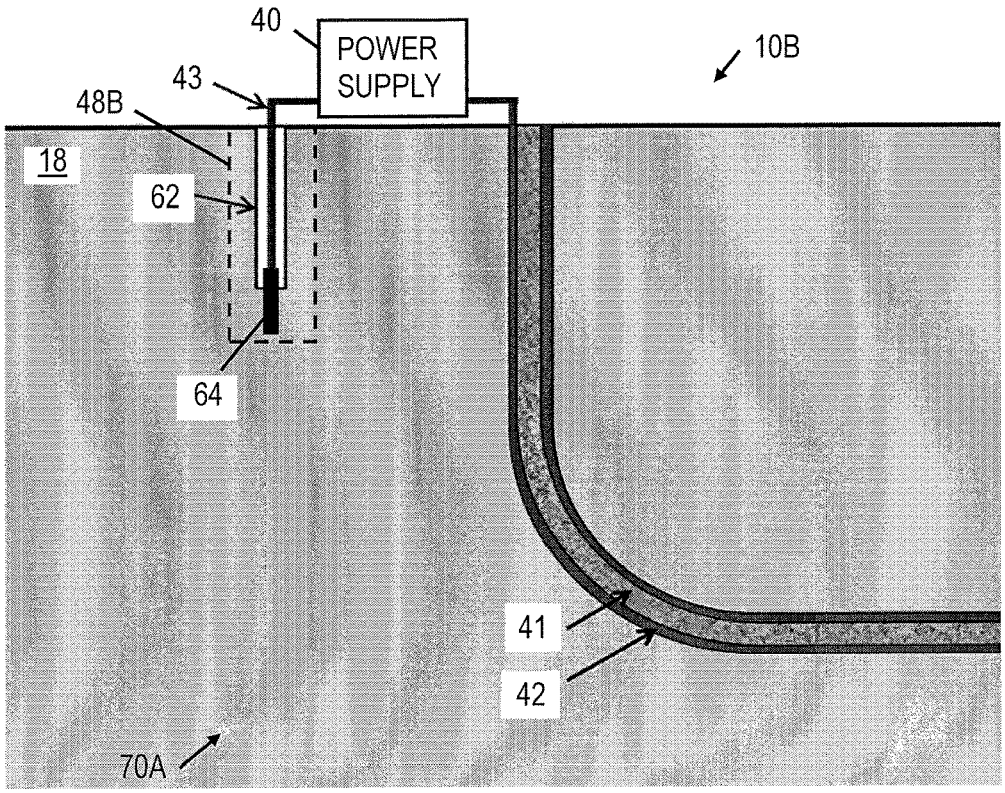
FIG. 2B is a schematic diagram showing part of surface excitation ranging scenario including a second supplemental grounding arrangement.

FIG. 2B shows part of a surface excitation ranging scenario 10B that includes a second supplemental grounding arrangement 48B. In scenario 10B, the target well 42 is again represented as being filled with drilling mud 41. The second supplemental grounding arrangement 48B is shown to include a downhole ground stake 64 installed in an open borehole 62 in the earth 18 and connected to the power supply 40 via an insulated cable 43. The open borehole 62 may be a new borehole drilled to install the downhole ground stake 64 or an available borehole nearby the target well 42. In some embodiments, a fiber glass insert or casing is used to maintain the integrity of the open borehole 62. As an option, the downhole ground stake 64 may be installed using a pilot hole instead of or in addition to the open borehole 62. The open borehole 62 and/or pilot hole is spaced from and within a predetermined range of the target well 42. In some embodiments, the downhole ground stake 64 corresponds to an exposed portion of a grounding cable (e.g., the insulated cable 43 can be used, where the end of the insulated cable 43 is exposed). In other embodiments, the downhole ground stake 64 corresponds to a customized ground stake having an increased length and/or an increased radius relative to a traditional ground stake. As an example, the downhole ground stake 64 may have a length of at least 10 meters, where most of the downhole ground stake 64 is in direct contact with the earth 18 once installation in complete. In some embodiments, the downhole ground stake 64 is installed in response to a test (e.g., an impedance test or SNR test). A downhole ground stake 64 as in the surface excitation ranging scenario 10B can be used to supplement a ground well (not shown). A downhole ground stake 64 as in the surface excitation ranging scenario 10B may also be combined with other supplemental grounding arrangement options described herein. The impedance for a customized grounding arrangement involving a downhole ground stake (radius=1 cm, length=10 meters, and $\sigma=10^6$S/m) installed in an open borehole with a length of 20 meters, has been estimated to be about 3.09 ohms.

Figure 2C:
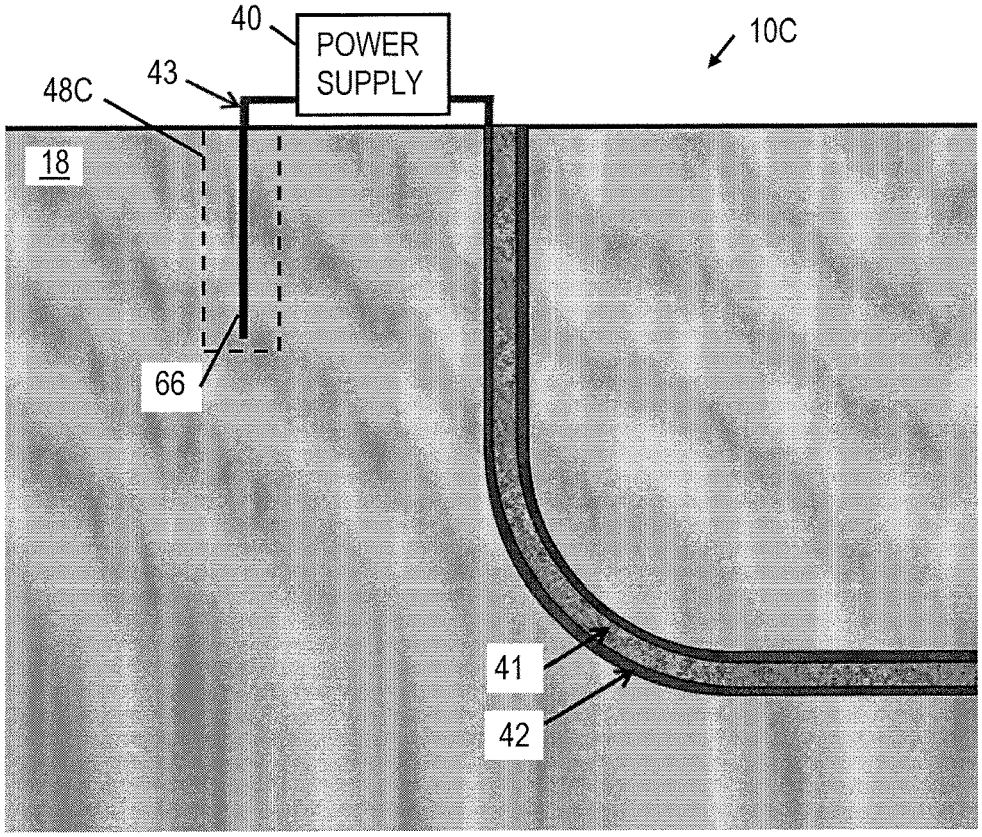
FIG. 2C is a schematic diagram showing part of surface excitation ranging scenario including a third supplemental grounding arrangement.

FIG. 2C shows part of a surface excitation ranging scenario 10C that includes a third supplemental grounding arrangement 48C. In scenario 10C, the target well 42 is again represented as being filled with drilling mud 41. The third supplemental grounding arrangement 48C is shown to include an elongated ground stake 66 that extends deep into the earth 18. The elongated ground stake 66 is connected to the power supply 40 via an insulated cable 43. To install the elongated ground stake 66 deep into the earth 18, a pilot hole may be used. Additionally or alternatively, a specialized tool or rig may be employed to push or hammer the elongated ground stake 66 into the earth 18 such that a predetermined portion of the elongated ground stake 66 is underground and in contact with the earth 18. The elongated ground stake 66 has an increased length and perhaps an increased radius relative to a traditional ground stake. As an example, the elongated ground stake 66 may have a length of at least 30 meters, where most of the elongated ground stake 66 is in direct contact with the earth 18 once installation in complete. In some embodiments, the elongated ground stake 66 is installed in response to a test (e.g., an impedance test or SNR test). An elongated ground stake 66 as in the surface excitation ranging scenario 10C can be used to supplement a ground well (not shown). A downhole ground stake 66 as in the surface excitation ranging scenario 10C may also be combined with other supplemental grounding arrangement options described herein. The impedance for a customized grounding arrangement involving an elongated ground stake (radius=1 cm, length=30 meters, and 6=$10^6$S/m), where most of the elongated ground stake contacts the earth, has been estimated to be about 1.28 ohms.

Figure 2D:
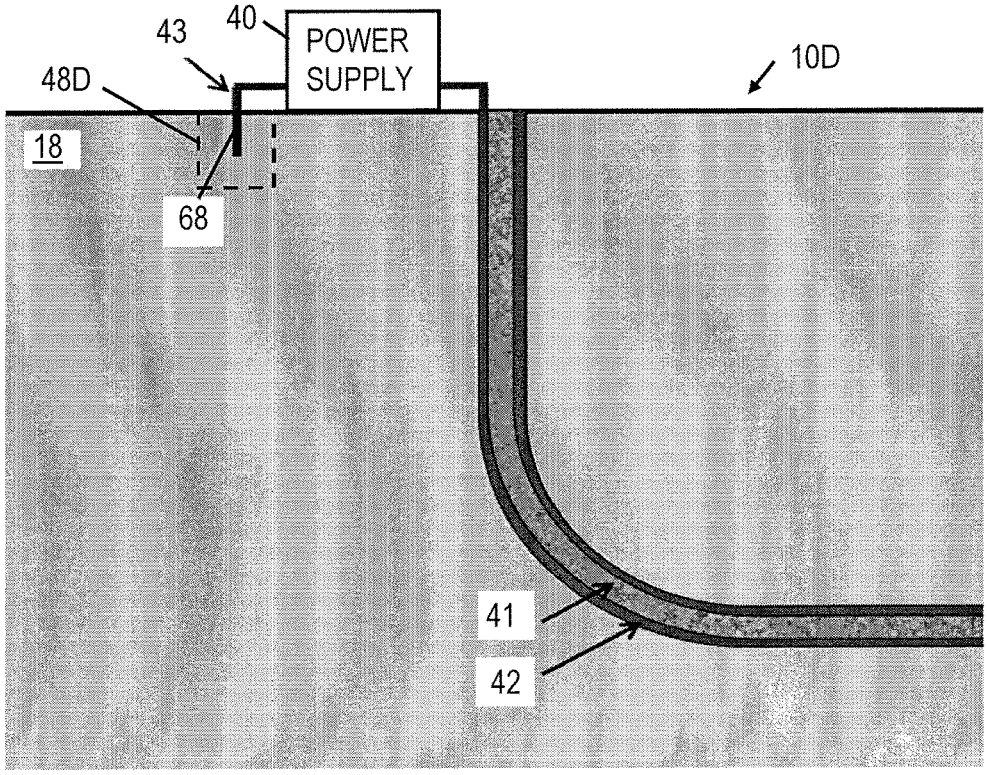
FIG. 2D is a schematic diagram showing part of surface excitation ranging scenario including a fourth supplemental grounding arrangement.

FIG. 2D shows part of a surface excitation ranging scenario 10D that includes a fourth supplemental grounding arrangement 48D. In scenario 10D, the target well 42 is again represented as being filled with drilling mud 41. The fourth supplemental grounding arrangement 48D is shown to include a ground stake 68 installed at earth's surface. The ground stake 68 is connected to the power supply 40 via an insulated cable 43. The ground stake 68 may correspond to a traditional ground stake. Alternatively, the ground stake 68 may have an increased length and perhaps an increased radius relative to a traditional ground stake. In some embodiments, the ground stake 68 is installed in response to a test (e.g., an impedance test or SNR test). An ground stake 68 as in the surface excitation ranging scenario 10D can be used to supplement a ground well (not shown). A ground stake 68 as in the surface excitation ranging scenario 10D may also be combined with other supplemental grounding arrangement options described herein. The impedance for a customized grounding arrangement involving an elongated ground stake (radius=1 cm, length=30 meters, and $\sigma=10^6$S/m), where most of the elongated ground stake contacts the earth, has been estimated to be about 1.28 ohms. Another supplemental grounding arrangement option involves using a rig anchor as a customized ground stake.

Figure 3:
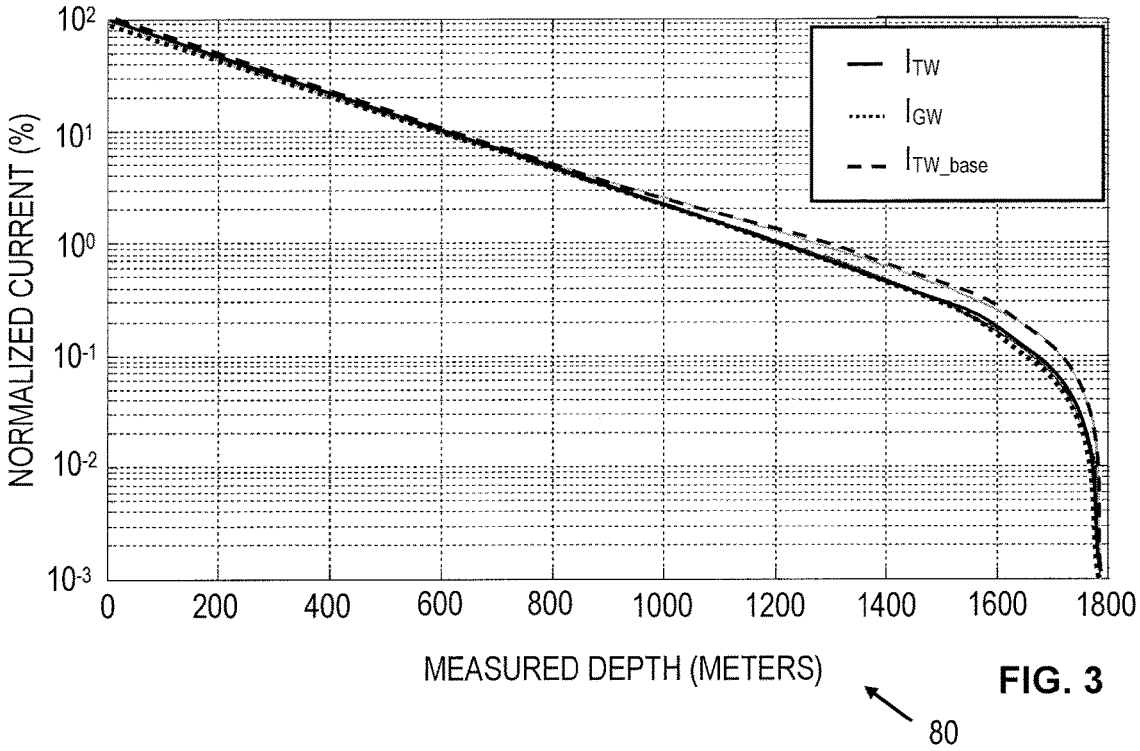
FIG. 3 is a graph showing normalized current distribution curves as a function of measured depth for a target well and a ground well.

FIG. 3 is a graph 80 showing normalized current distribution curves as a function of measured depth for a target well and a ground well. In graph 80, the solid line represent a target well current ($I_{TW}$) and the dotted line represents a related ground well current ($I_{GW}$). For comparison, the dashed line in graph 80 represents a target well current ($I_{TW_base}$) when a base grounding arrangement alone is used. Compared to the target well current when a base grounding arrangement alone is used, the target well current when a ground well is used is a little lower yet extends to approximately the same measured depth. It should be noted that the ground well is able to significantly reduce impedance compared to a base grounding arrangement (i.e., at the same power level the ground well can provide more current to the target well compared to the base grounding arrangement). Further, it can be seen that the target well current and the related ground well current are approximately the same as a function of measured depth.

Figure 4:
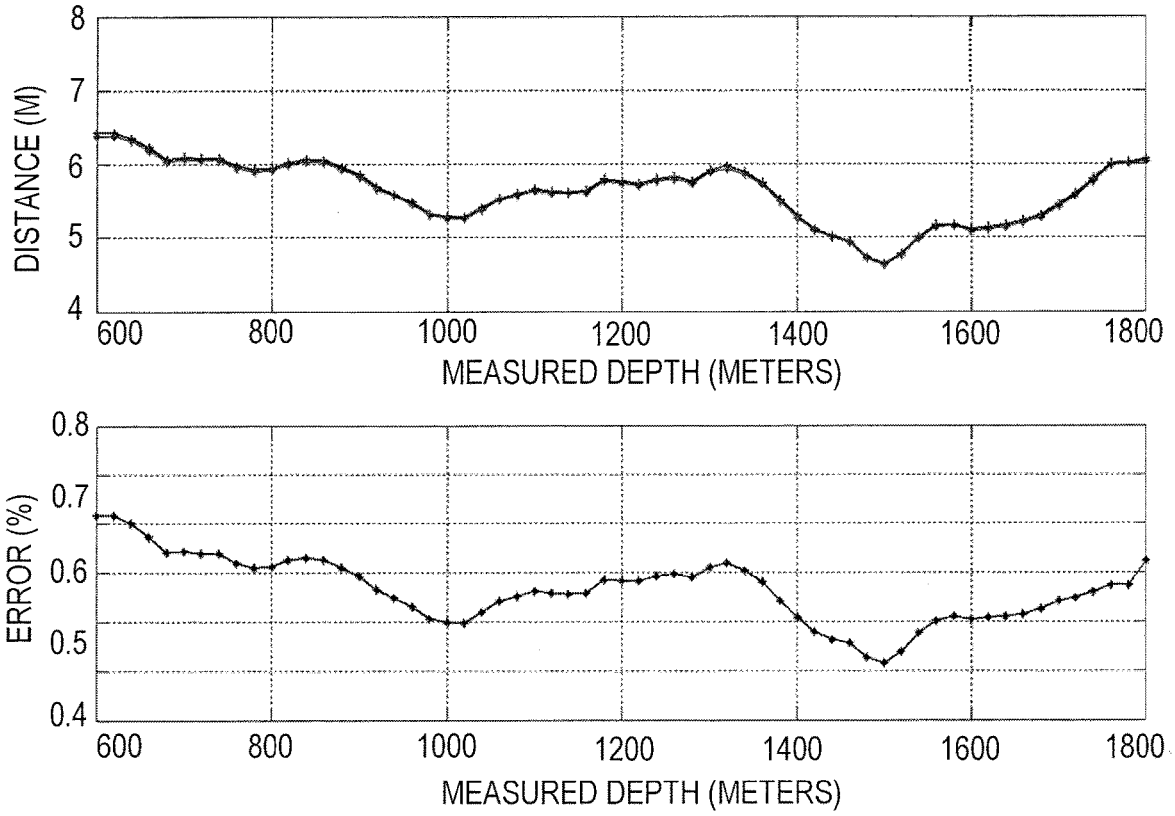
FIG. 4 is a set of graphs showing ranging error variance due to interference from a ground well.

FIG. 4 is a set of graphs showing results of a study to analyze ranging signal interference due to a ground well for a particular scenario. For the scenario of FIG. 4, the ground well is assumed to be parallel to the target well at a distance of 100 m. As shown in the upper plot, the spacing between a new well and the target well is assumed to vary between 4 to 7 m at different depths. Meanwhile, the error in the lower plot represents the difference in percentage between the true distance and the calculated distance due to interference of the ground well. The study results indicate that the amount of ranging signal interference caused by the ground well is dependent on the relative spacing between the new well, the target well, and the ground well.

Figure 5:
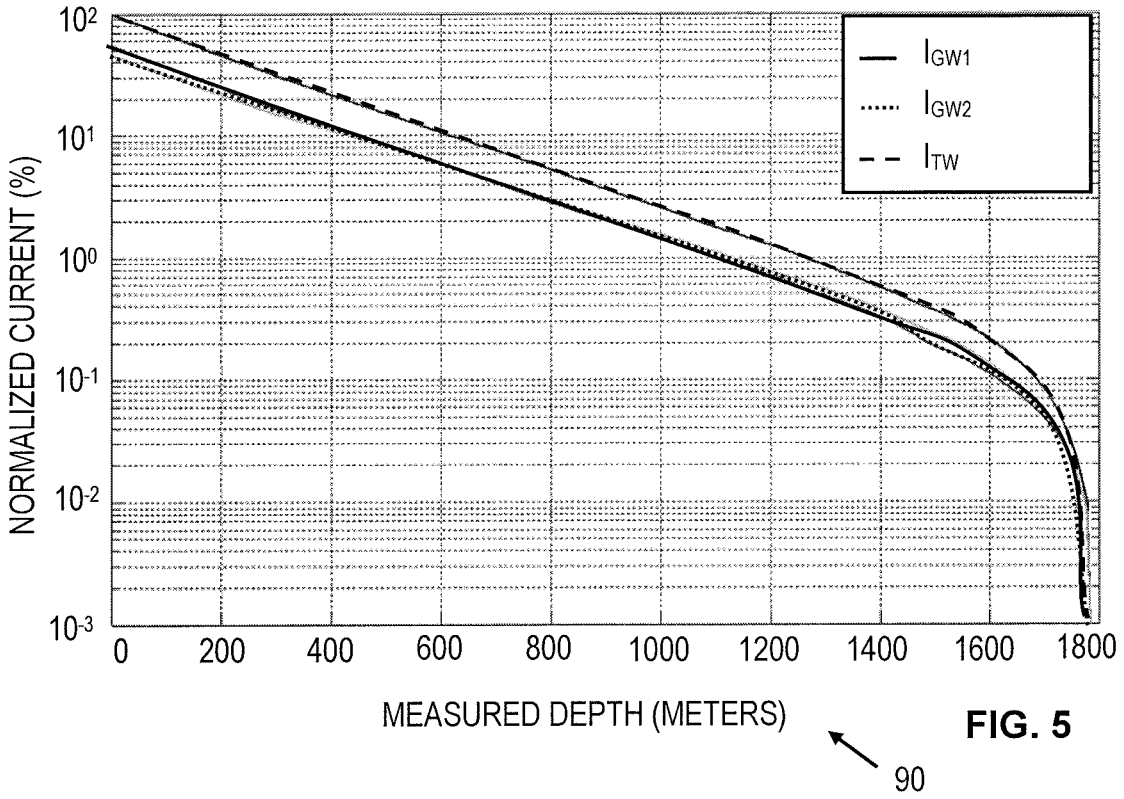
FIG. 5 is a graph showing normalized current distribution curves as a function of measured depth for a target well and two ground wells.

FIG. 5 is a graph 90 showing normalized current distribution curves as a function of measured depth for a target well and two ground wells. In graph 90, the solid line represents a first ground well current ($I_{GW1}$) and the dotted line represents a second ground well current ($I_{GW2}$). Meanwhile, the dashed line represents the related target well current ($I_{TW}$). As shown in graph 90, the current level conveyed along each of the first and second ground wells is approximately half the current level conveyed along the target well. Therefore, the interference on ranging performance from the first and second ground wells will be much less than the interference from a single ground well. Compared to the surface impedance when using a single ground well, the estimated surface impedance for two ground wells is reduced by about 19% (calculated as 0.077Ω).

Figure 6:
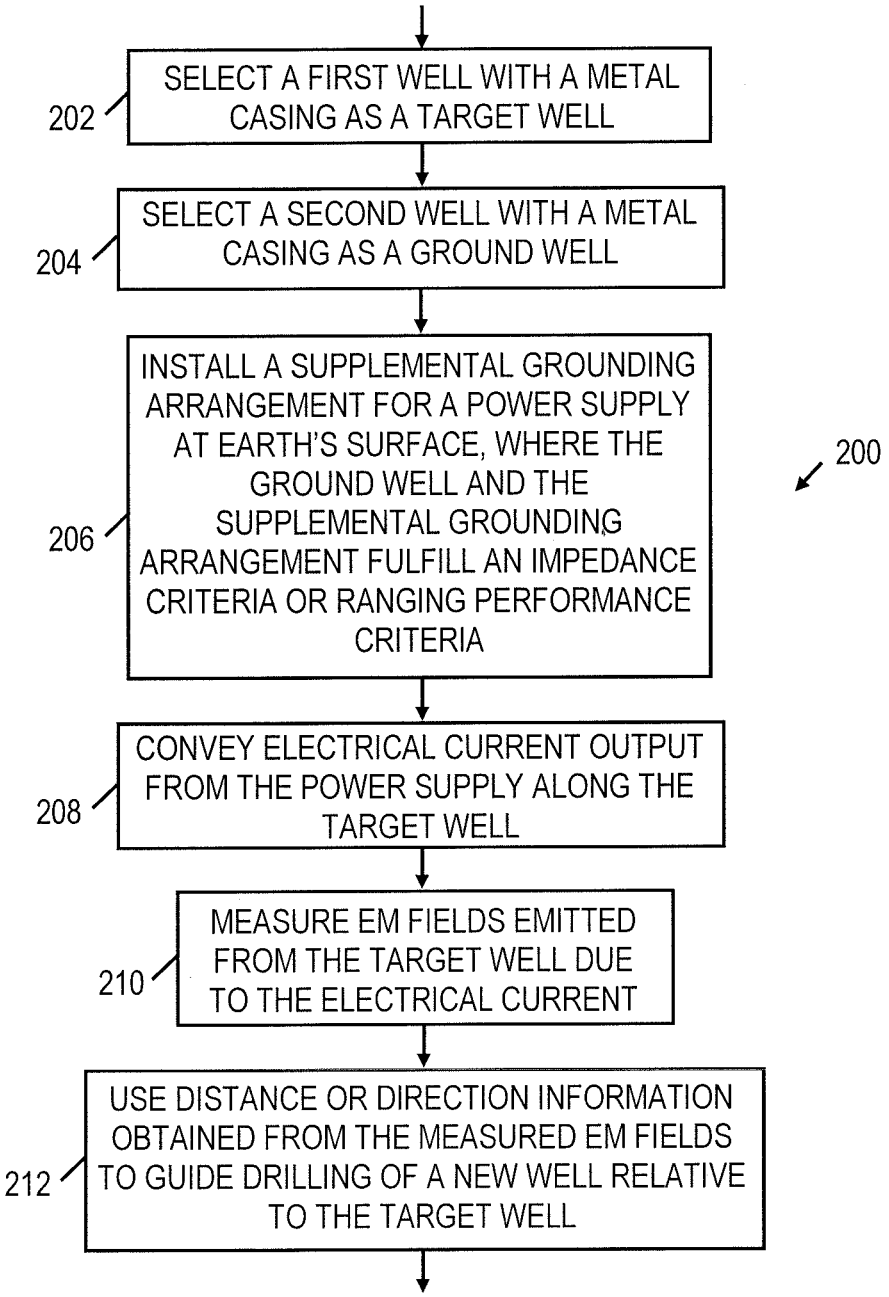
FIG. 6 is a flowchart of an illustrative surface excitation ranging method involving a ground well and a supplemental grounding arrangement.

FIG. 6 is a flowchart 200 of an illustrative surface excitation ranging method 200 involving a ground well and a supplemental grounding arrangement. As shown, the method 200 includes selecting a first well with a metal casing as a target well at block 202. At block 204, a second well with a metal casing is selected as a ground well. At block 206, a supplemental grounding arrangement is installed for a power supply at earth's surface, where the ground well and the supplemental grounding arrangement fulfill an impedance criteria or ranging performance criteria. The impedance criteria or ranging performance criteria may be based on testing operations to measure a grounding impedance or ranging performance. Such testing operations may be performed during ranging operations or before ranging operations. Further, experience from previous surface excitation ranging projects can be used to guide new projects. Further, available or new logs related to electromagnetic properties of the earth near a target well or new well can be used to select options for a ground well and a supplemental grounding arrangement. As desired, supplemental grounding arrangement options can be combined or adjusted (e.g., additional ground wells, a longer ground stake, or a deeper installation can be used). Once installation of the supplemental grounding arrangement is complete (or is adjusted in response to a test as the case may be), the method 200 involves conveying an electrical current output from the power supply along the target well (block 208). At block 210, EM fields emitted from the target well due to the electrical current are measured. At block 212, distance or direction information obtained from the measured EM fields are used to guide drilling of a new well relative to the target well.

Embodiments disclosed herein include:

A: A surface excitation ranging method that comprises selecting a first well with a metal casing as a target well and selecting a second well with a metal casing as a ground well. The method also comprises installing a supplemental grounding arrangement for a power supply located at earth's surface, wherein the ground well and the supplemental grounding arrangement fulfill an impedance criteria or ranging performance criteria. The method also comprises conveying an electrical current output from the power supply along the target well. The method also comprises sensing EM fields emitted from the target well due to the electrical current. The method also comprises using distance or direction information obtained from the sensed EM fields to guide drilling of a new well relative to the target well.

B: A surface excitation ranging system that comprises a power supply located at earth's surface. The system also comprises a ground well and a supplemental grounding arrangement for the power supply, wherein the ground well and the supplemental grounding arrangement fulfill an impedance criteria or a ranging performance criteria. The system also comprises a target well with a metal casing to convey an electrical current output from the power supply along its length. The system also comprises at least one sensor to detect EM fields emitted from the target well due to the electrical current. The system also comprises a directional drilling tool to drill a new well relative to the target well based on distance or direction information obtained from the detected EM fields.

Each of the embodiments, A and B, may have one or more of the following additional elements in any combination. Element 1: wherein installing the supplemental grounding arrangement comprises connecting the power supply to a metal casing installed in a well separate from the target well, the ground well, and the new well. Element 2: wherein installing the supplemental grounding arrangement comprises connecting the power supply to a ground stake deployed entirely below earth's surface. Element 3: further comprising drilling an open borehole or using an available open borehole to deploy the ground stake entirely below earth's surface. Element 4: further comprising drilling a pilot hole to deploy the ground stake entirely below earth's surface. Element 5: wherein installing the supplemental grounding arrangement comprises connecting the power supply to an elongated ground stake with an underground length that exceeds a predetermined threshold. Element 6: wherein installing the supplemental grounding arrangement comprises connecting the power supply to a grounding cable having an insulated portion and an exposed portion, and wherein the exposed portion is below earth's surface. Element 7: further comprising spacing the supplemental grounding arrangement from the target well based on predetermined distance or range criteria, and extending an insulated cable between the power supply and a grounding location below earth's surface. Element 8: further comprising adjusting supplemental grounding arrangement options until an impedance is below a threshold associated with the impedance criteria. Element 9: further comprising adjusting supplemental grounding arrangement options until a ranging SNR is above a threshold associated with the ranging performance criteria.

Element 10: wherein the supplemental grounding arrangement comprises a metal casing installed in a well separate from the target well, the ground well, and the new well. Element 11: wherein the supplemental grounding arrangement comprises a ground stake deployed entirely below earth's surface. Element 12: wherein the ground stake is deployed entirely below earth's surface using an open borehole. Element 13: wherein the ground stake is deployed entirely below earth's surface using a pilot hole. Element 14: wherein the supplemental grounding arrangement comprises an elongated ground stake with an underground length that exceeds a predetermined threshold. Element 15: wherein the supplemental grounding arrangement comprises a grounding cable with an insulated portion and an exposed portion, wherein the exposed portion is below earth's surface. Element 16: wherein the supplemental grounding arrangement comprises an insulated cable that extends between the power supply and a location below earth's surface. Element 17: wherein the supplemental grounding arrangement is spaced from the target well based on predetermined distance or range criteria. Element 18: further comprising a resistivity or conductivity logging tool to collect formation property measurements at one or more points along the target well, wherein the impedance criteria is based on the collected measurements.

Numerous other variations and modifications will become apparent to those skilled in the art once the above disclosure is fully appreciated. For example, the supplemental grounding arrangement options described herein may also be used to improve safety or performance of production monitoring operations, reservoir monitoring operations, EM telemetry, and/or other operations involving a power supply at earth's surface. It is intended that the following claims be interpreted to embrace all such variations and modifications where applicable.

What is claimed is:

1. A surface excitation ranging method that comprises:

selecting a first well with a metal casing as a target well;

selecting a second well with a metal casing as a ground well;

installing a supplemental grounding arrangement for a power supply located at earth's surface, wherein the ground well and the supplemental grounding arrangement fulfill an impedance criteria or ranging performance criteria;

conveying an electrical current output from the power supply along the target well; sensing electromagnetic (EM) fields emitted from the target well due to the electrical current; and using distance or direction information obtained from the sensed EM fields to guide drilling of a new well relative to the target well.

2. The method of claim 1, wherein installing the supplemental grounding arrangement comprises connecting the power supply to a metal casing installed in a well separate from the target well, the ground well, and the new well.

3. The method of claim 1, wherein installing the supplemental grounding arrangement comprises connecting the power supply to a ground stake deployed entirely below earth's surface.

4. The method of claim 3, further comprising drilling an open borehole or using an available open borehole to deploy the ground stake entirely below earth's surface.

5. The method of claim 3, further comprising drilling a pilot hole to deploy the ground stake entirely below earth's surface.

6. The method of claim 1, wherein installing the supplemental grounding arrangement comprises connecting the power supply to an elongated ground stake with an underground length that exceeds a predetermined threshold.

7. The method of claim 1, wherein installing the supplemental grounding arrangement comprises connecting the power supply to a grounding cable having an insulated portion and an exposed portion, and wherein the exposed portion is below earth's surface.

8. The method of claim 1, further comprising spacing the supplemental grounding arrangement from the target well based on predetermined distance or range criteria, and extending an insulated cable between the power supply and a grounding location below earth's surface.

9. The method according to claim 1, further comprising adjusting supplemental grounding arrangement options until an impedance is below a threshold associated with the impedance criteria.

10. The method according to claim 1, further comprising adjusting supplemental grounding arrangement options until a ranging signal-to-noise ratio (SNR) is above a threshold associated with the ranging performance criteria.

11. A surface excitation ranging system that comprises:

a power supply located at earth's surface;

a ground well and a supplemental grounding arrangement for the power supply, wherein the ground well and the supplemental grounding arrangement are configured to fulfill an impedance criteria or a ranging performance criteria;

a target well with a metal casing to convey an electrical current output from the power supply along its length;

at least one sensor to detect electromagnetic (EM) fields emitted from the target well due to the electrical current; and a directional drilling tool to drill a new well relative to the target well based on distance or direction information obtained from the detected EM fields.

12. The system of claim 11, wherein the supplemental grounding arrangement comprises a metal casing installed in a well separate from the target well, the ground well, and the new well.

13. The system of claim 11, wherein the supplemental grounding arrangement comprises a ground stake deployed entirely below earth's surface.

14. The system of claim 13, wherein the ground stake is deployed entirely below earth's surface using an open borehole.

15. The system of claim 13, wherein the ground stake is deployed entirely below earth's surface using a pilot hole.

16. The system of claim 11, wherein the supplemental grounding arrangement comprises an elongated ground stake with an underground length that exceeds a predetermined threshold.

17. The system of claim 11, wherein the supplemental grounding arrangement comprises a grounding cable with an insulated portion and an exposed portion, wherein the exposed portion is below earth's surface.

18. The system of claim 11, wherein the supplemental grounding arrangement comprises an insulated cable that extends between the power supply and a location below earth's surface.

19. The system of claim 11, wherein the supplemental grounding arrangement is spaced from the target well based on predetermined distance or range criteria.

20. The system according to claim 11, further comprising a resistivity or conductivity logging tool to collect formation property measurements at one or more points along the target well, wherein the impedance criteria is based on the collected measurements.

* * * * *